US007467572B2

(12) United States Patent
Fisher et al.

(10) Patent No.: US 7,467,572 B2
(45) Date of Patent: Dec. 23, 2008

(54) HAMMER WITH MALLET HEAD AND MEASURING HANDLE

(75) Inventors: Kathleen Fisher, Lindenhurst, IL (US); Jeffrey A. DeBoer, Ann Arbor, MI (US); Michael Nellenbach, Clawson, MI (US)

(73) Assignee: The Faucet Queens, Inc., Vernon Hills, IL (US)

( * ) Notice: Subject to any disclaimer, the term of this patent is extended or adjusted under 35 U.S.C. 154(b) by 0 days.

(21) Appl. No.: 11/670,672

(22) Filed: Feb. 2, 2007

(65) Prior Publication Data

US 2007/0119279 A1 May 31, 2007

Related U.S. Application Data

(63) Continuation-in-part of application No. 10/980,065, filed on Nov. 3, 2004, now abandoned.

(51) Int. Cl.
*B25B 1/02* (2006.01)

(52) U.S. Cl. ..... 81/25; 81/20; 81/21; 81/22

(58) Field of Classification Search ..... 81/20, 81/21, 22, 25; 7/164
See application file for complete search history.

(56) References Cited

U.S. PATENT DOCUMENTS

| | | | | | |
|---|---|---|---|---|---|
| 2,765,827 | A * | 10/1956 | Hall | ..... | 81/21 |
| 4,697,481 | A | 10/1987 | Maeda | | |
| 4,732,058 | A | 3/1988 | Chung | | |
| 4,813,089 | A | 3/1989 | Anderson | | |
| 5,657,763 | A | 8/1997 | Schneider | | |
| 5,826,466 | A * | 10/1998 | Weissbach | ..... | 81/26 |
| 6,088,862 | A | 7/2000 | Bulcock | | |
| 6,122,788 | A | 9/2000 | Bulcock | | |
| 6,188,228 | B1 | 2/2001 | Philipp | | |
| 6,279,876 | B1 | 8/2001 | Massie | | |
| 7,013,516 | B1 * | 3/2006 | Peters | ..... | 7/146 |

* cited by examiner

*Primary Examiner*—Joseph J Hail, III
*Assistant Examiner*—Shantese L McDonald
(74) *Attorney, Agent, or Firm*—Cohen & Grigsby, P.C.

(57) ABSTRACT

A hammer equipped with a mallet attachment and a measuring scale. The mallet attachment includes a surface cap for covering the striking surface of the hammer such that the hammer is visible as a mallet which provides a resilient surface. A surface cap holder stores the surface cap when using the hammer. The measuring scale is located on a grip which surrounds a hammer shank. The hammer functions as both a hammer and a mallet.

12 Claims, 3 Drawing Sheets

HAMMER WITH MALLET HEAD AND MEASURING HANDLE

REFERENCE TO RELATED APPLICATION

This application claims priority to and is a continuation-in-part of U.S. application Ser. No. 10/980,065, filed Nov. 3, 2004 now abandoned.

BACKGROUND OF THE INVENTION

The present invention relates to a hammer, and more particularly to a hammer equipped with a resilient mallet attachment and a measuring handle.

It is frequently convenient to have a tool which performs a multiple of functions. This is especially true when hanging a picture or other wall hangings. To complete this task, a hammer is typically required to drive fasteners. A tape measure may also be required to properly space the height and/or the distance between other wall hangings. To prevent damage to a wall or the wall hanging itself, a mallet may also be needed.

Multi-function hammers with some functionality to measure distances are known. Hammers of this type typically include a handle with an integrated tape measure. Hammers that include a handle with a measuring scale thereon are also known. Conventional multi-functional hammers are effective, but may be less than desirable from a convenience arid integration standpoint.

Accordingly, it is desirable to provide a multi-purpose hammer which is functional and uncomplicated yet does not detract from the primary hammer function.

SUMMARY OF THE INVENTION

The hammer of the present invention provides a tool with the functionality of a conventional hammer and a mallet.

The present invention includes a handle, a hammer head, and a mallet attachment. The handle includes a measuring scale thereon and a surface cap holder at one end thereof. The hammer head defines a striking surface, a central body and a set of claws and is located on the opposite end of the handle from the surface cap holder. A mallet attachment is removably affixed to the surface cap holder of the handle.

The mallet attachment defines a surface cap having a storage base. The surface cap is placed over the striking surface when utilizing the hammer as a mallet. The storage base is securely affixed on or within the surface cap holder to store the surface cap when utilizing the hammer conventionally. The mallet attachment is connectable to the surface cap holder and allows for the selective movement of the surface cap.

The hammer of the present invention provides an uncomplicated multi-purpose tool which measures distances and functions both as a conventional hammer and a mallet.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
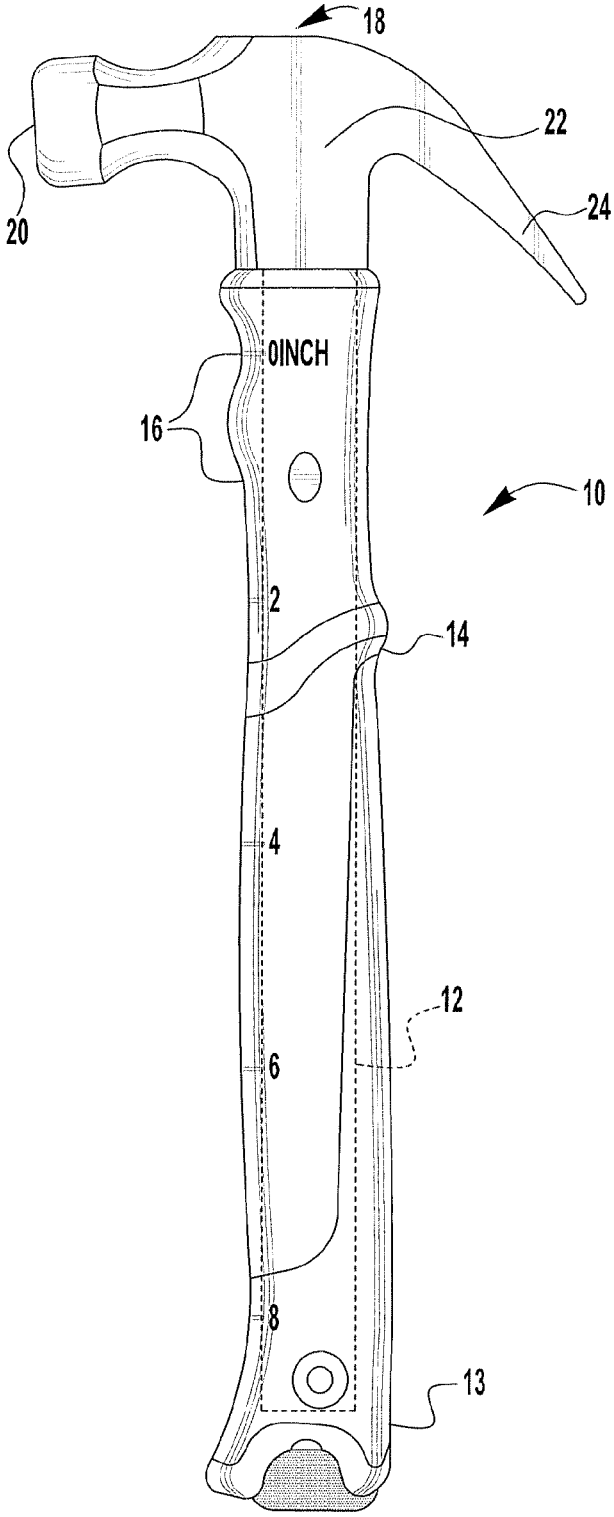
FIG. 1 is a general perspective view of the hammer in accordance with the present invention.

The hammer 10 of the present invention is illustrated in FIG. 1. A shaft 12 has the general form of an elongated rectangle. The shaft 12 is preferably manufactured of a metallic material. A grip 14 is formed around a portion of the shaft 12. The grip 14 is preferably manufactured of a resilient material such as rubber and/or plastic. Grip contours 16 are provided for improved gripping, aesthetic and ergonomic purposes.

A hammer head 18 is mounted to the shaft 12 on an end thereof. The hammer head 18 defines a striking surface 20, a central body 22 and a set of claws 24. The striking surface 20 is disposed on one side of the central body 22. The set of claws 24 is disposed on the opposite side of central body 22 from the striking surface 20. The striking surface 20 is generally a solid cylindrical member with a flat face for striking fasteners. The set of claws 24 functions to remove fasteners. A surface cap holder 32 is disposed on the opposite end 13 of shaft 12 from the hammer head 18. Alternatively the surface cap holder 32 is an integral part of shaft 12. A mallet attachment 26 is removably connected to the surface cap holder 32 on end 13 of hammer 10.

Figure 2:
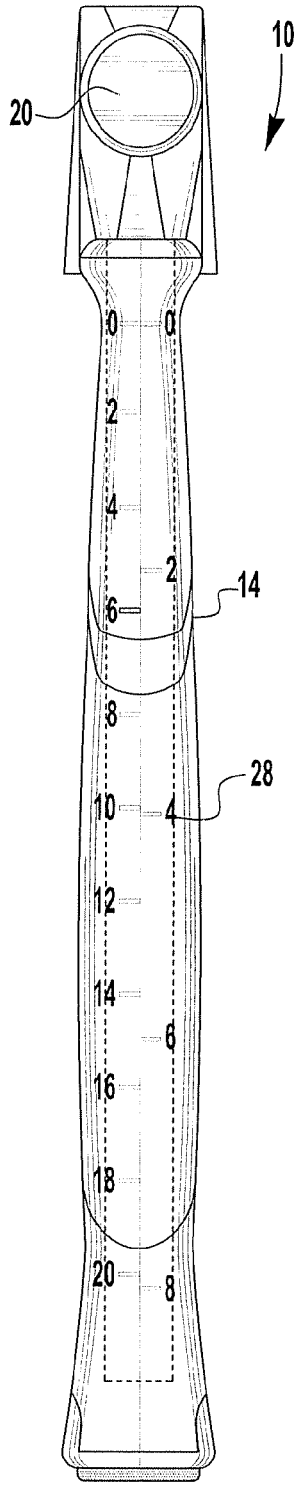
FIG. 2 is an illustrative view of an embodiment of the measuring handle of the present invention.

Referring to FIG. 2, the grip 14 includes a numeric scale 28 thereon. The numeric scale 28 can be of the English and/or Metric systems. Preferably, the numeric scale 28 is positioned on the striking surface 20 side of the hammer 10 on the grip 14, however other locations may also be utilized with the present invention. It is preferred that the numeric scale 28 be capable of measuring distances up to at least one foot.

Figure 3A:
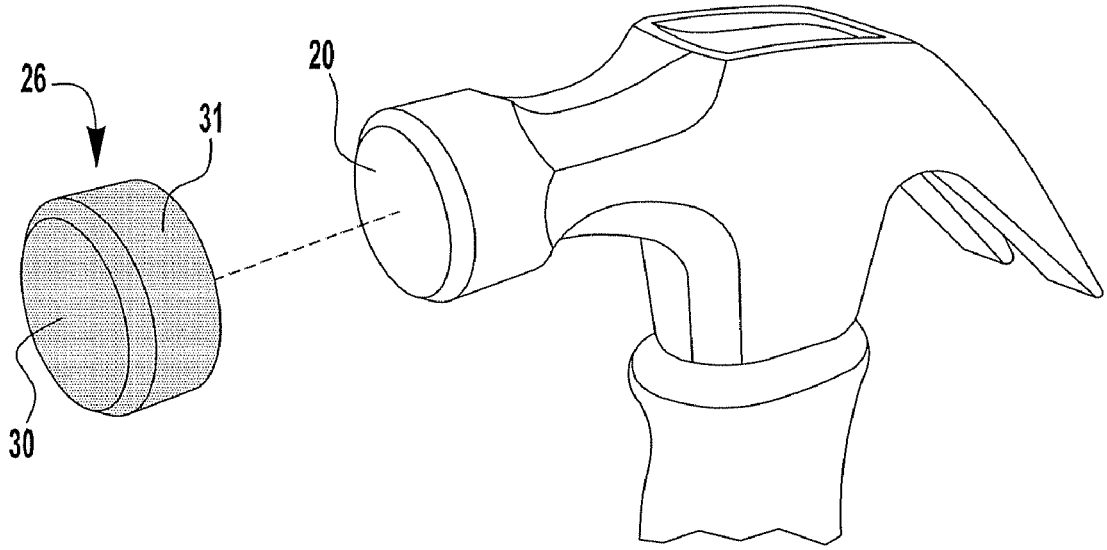
FIG. 3A is an illustrative view of an embodiment of the mallet attachment of the present invention detached from the striking surface of a hammer head.
Figure 3B:
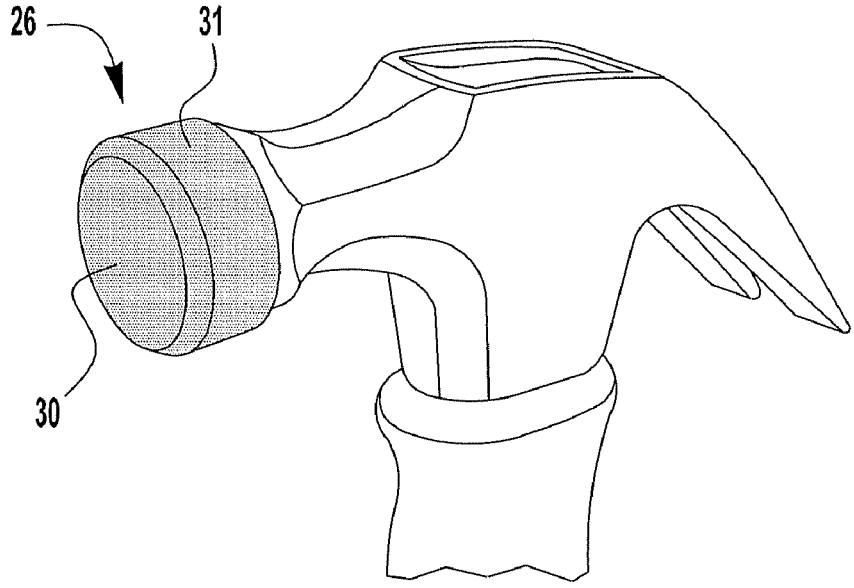
FIG. 3B is an illustrative view of an embodiment of the mallet attachment of the present invention mounted to the striking surface of a hammer head.

Referring to FIG. 3A, the mallet attachment 26 defines a surface cap 30 and a storage base 31. Preferably, the mallet attachment 26 is manufactured of a resilient material such as rubber and/or plastic. It should be understood that other materials may be utilized in the construction of the mallet attachment 26 of the present invention. The surface cap 30 is cylindrical. Storage base 31 includes a hollow portion that allows the surface cap 30 to fit over the striking surface 20 as shown in the mallet position in FIG. 3B. Surface cap 30 selectively covers the striking surface 20.

Figure 4B:
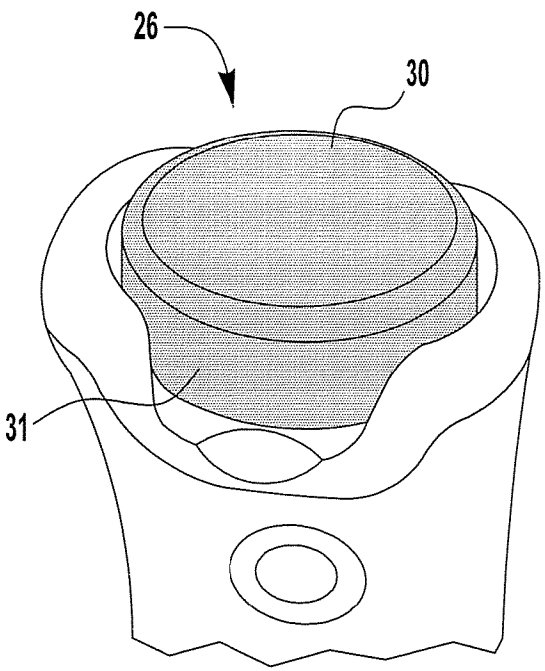
FIG. 4B is an illustrative view of an embodiment of the hammer of the present invention with the mallet attachment of the device in a stored position.
Figure 4A:
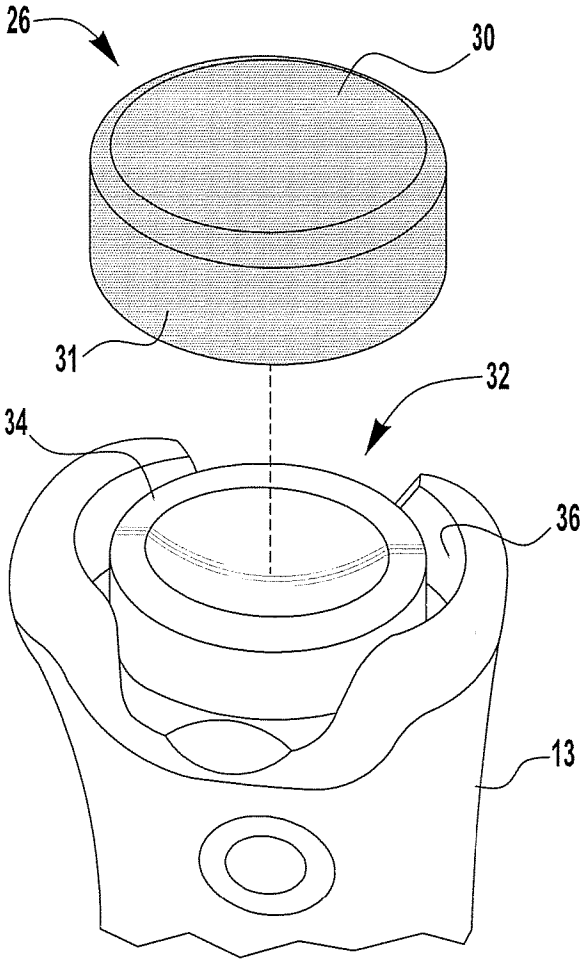
FIG. 4A is an illustrative view of an embodiment of the hammer of the present invention with the mallet attachment of the device in a mallet position.

Referring to FIG. 4A, the surface cap holder 32 is circular shaped and includes a surface cap attachment 34 and a storage aperture 36 for storing the surface cap 30. The surface cap attachment 34 is generally circular shaped to accommodate the contours of storage base 31. Surface cap attachment 34 protrudes from end 13 and is designed to allow for the selective movement of the surface cap 30. In an embodiment, surface cap holder 32 is integral with hammer end 13. Alternatively, it is a separable piece. Preferably, surface cap attachment 34 and storage aperture 36 are constructed out of a rigid plastic material. It should be understood that other materials may be utilized in the constriction of surface cap attachment 34 and storage aperture 36.

Referring to FIG. 4B, the mallet attachment 26 is shown in the stored position. Surface cap 30 is selectively pressed into the storage aperture 36 about surface cap attachment 34 of the surface cap holder 32. In this position, the mallet attachment 26 is securely stored in a position to allow full use of hammer 10.

That the foregoing description shall be interpreted as illustrative and not in a limiting sense is thus made apparent. A worker of ordinary skill in the art would recognize that certain modifications would come within the scope of this invention. For that reason, the following claims should be studied to determine the true scope and content of this invention.

What is claimed is:

1. A hammer, comprising:

a handle;

a surface cap holder having a bottom portion, a wall extending from a perimeter of the bottom portion and a surface cap attachment protruding from the bottom surface and forming a channel between the surface cap attachment and the wall of the surface cap holder, said surface cap holder disposed at one end of said handle;

a hammer head transversely mounted to an opposite end of said handle; and a resilient mallet attachment mountable to said surface cap holder, said resilient mallet attachment defining a surface cap and a base movable to selectively cover a striking surface of said hammer head and fasten securely within the channel of the surface cap holder.

2. The hammer as recited in claim 1, wherein said handle includes a measuring scale.

3. The hammer as recited in claim 1, wherein said hammer head defines a striking surface, a central body and a set of claws.

4. The hammer as recited in claim 3, wherein said resilient mallet attachment is selectively mounted to said hammer head on said striking surface.

5. The hammer as recited in claim 1, wherein said surface cap holder is disposed on a nonstriking end of said hammer.

6. The hammer as recited in claim 1, wherein said surface cap holder is integral with said one end of said hammer.

7. The hammer as recited in claim 1, wherein said channel is designed to accommodate the contours of said base.

8. The hammer as recited in claim 1, wherein said mallet attachment is movable to selectively store said base at least partially within said surface cap holder.

9. The hammer as recited in claim 1 wherein the surface cap holder is removable from the hammer.

10. A method of providing a mallet surface for a hammer, comprising the steps of:

(1) removing the base of a surface cap from a channel of a surface cap holder disposed at one end of hammer, wherein the channel is formed between a surface cap attachment and a wall extending from a perimeter of a bottom portion of the surface cap holder; and (2) pressing the surface cap over a striking surface on the opposite end of said hammer to provide a mallet surface.

11. The method as recited in claim 10, wherein said step (1) further comprises the step of:

retaining the surface cap within the channel of said surface cap holder.

12. The method as recited in claim 10, comprising the further step of removing the surface cap holder from the end of the hammer.

* * * * *